US005669593A

United States Patent [19]

Kirchner

[11] Patent Number: 5,669,593

[45] Date of Patent: Sep. 23, 1997

[54] PICTURE HANGING DEVICE

[76] Inventor: Richard N. Kirchner, 11204 Gasch, Harvard, Ill. 60033

[21] Appl. No.: 487,939

[22] Filed: Jun. 7, 1995

[51] Int. Cl.[6] ..... A47G 1/24

[52] U.S. Cl. ..... 248/476; 248/325; 248/479; 248/489

[58] Field of Search ..... 248/479, 476, 248/489, 490, 325, 480; 40/757, 759

[56] References Cited

U.S. PATENT DOCUMENTS

| | | | |
|---|---|---|---|
| 175,723 | 4/1876 | McGill . | |
| 549,505 | 11/1895 | Eldridge | 248/489 |
| 1,505,504 | 8/1924 | Stoner | 248/325 |
| 2,810,226 | 10/1957 | Horwitt | 248/490 X |
| 3,294,356 | 12/1966 | Sherman . | |
| 3,363,341 | 1/1968 | Glassman | 248/490 X |
| 3,861,639 | 1/1975 | Morrill . | |
| 4,069,998 | 1/1978 | Rytting . | |
| 4,085,917 | 4/1978 | Brantley, Jr. . | |
| 4,437,639 | 3/1984 | Stein . | |
| 4,449,688 | 5/1984 | Robins . | |
| 4,591,125 | 5/1986 | Bellehumeur . | |
| 4,892,284 | 1/1990 | Kelrick . | |
| 5,342,014 | 8/1994 | Wilson . | |

*Primary Examiner*—Korie Chan
*Attorney, Agent, or Firm*—Mathew R. P. Perrone, Jr.

[57] ABSTRACT

A hanging device includes a wall mount and an adjustable weight device for hanging pictures. The adjustable weight being slidably adjusted on the wall mount for properly positioning a picture in a desired position. The hanging device can also be used to mount other items on a wall.

2 Claims, 3 Drawing Sheets

PICTURE HANGING DEVICE

This invention relates to a picture hanging device, and more particularly to a picture hanging device that can be adjusted to hang the picture in a proper position.

BACKGROUND OF THE INVENTION

A certain degree of skill is required to hang a picture so that it is substantially parallel and square with the wall on which it was mounted. This requires a certain degree of skill in mounting the picture and having it achieve the desired position. Many hanging devices for pictures or other wall ornaments are known. However, no device is known, which can simply and efficiently adjust the position of that item desired to be hung on a wall, to the preferred position.

For example, an assumption is made that the item to hung is of a generally rectangular shape. The preferred position is to have a first pair of opposing sides of the rectangle parallel to the floor and a second pair of opposing sides of the rectangle perpendicular to the floor.

The procedure generally requires a mounting device on the picture or other item to be hung, and a mounting device on the wall. The mounting device on the picture must be properly positioned in order for it to join with the mounting device on the wall in order to achieve the desired positioning. If there is a slight variation in the mounting device on the picture or the mounting device on the wall, it becomes difficult if not impossible to mount the picture in proper fashion.

In order to achieve the desired mounting, it is then required to adjust the hanging device and achieve the desired results. This adjustment of the hanging device is difficult and can severely damage the item desired to be hung. It is highly desirable to develop a device which when mounted on the picture even in a slightly inaccurate position, can be adjusted to achieve the desired positioning.

SUMMARY OF THE INVENTION

Among the many objectives of this invention is the provision of a hanging device having a wall mount to be attached to a wall and an adjustable weight device to be mounted on a picture or other item to be hung.

Another objective of this invention is to provide a hanging device, wherein the wall mount and the weight device are movable in relationship to the other.

Yet another objective of this invention is to provide a hanging device to mount an item in a preferred position.

Still another objective of this invention is to provide a hanging device, which is adjustable.

Additionally, an objective of this invention is to provide a hanging device, which permits an item mounted on a wall to have an adjustable position.

Also, an objective of this invention is to provide a hanging device, which can minimize the difficulty in obtaining a precise positioning required for a hanging device.

A further objective of this invention is to provide a hanging device, which is easily installed.

A still further objective of this invention is to provide a hanging device, which permits in place adjustment of an item hung on a wall.

Yet a further objective of this invention is to provide a hanging device, which avoids damage to a wall.

These and other objectives of the invention (which other objectives become clear by consideration of the specification, claims and drawings as a whole) are met by providing a hanging device, including a wall mount and an adjustable weight device to be placed on the item to be hung.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
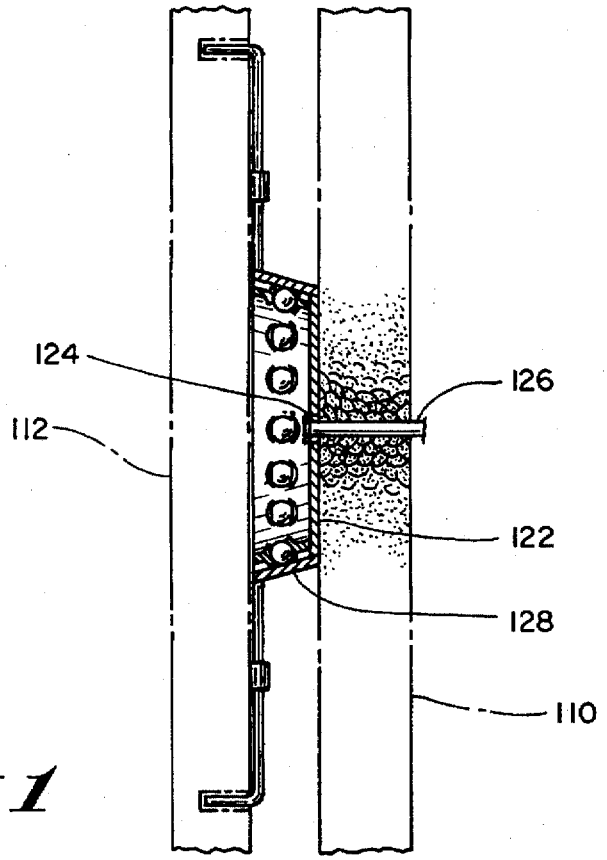
FIG. 1 is a top plan view of the first hanging device 100 in partial cross-section.

To hang the picture or other item with the hanging device of this invention, a wall mount is mounted on the wall or other support surface. Also, an adjustable weight device is mounted on the picture or other item to be hung. The adjustable weight device joins with the wall mount to form the hanging device and hang the item attached thereto. The wall mount may have a movable member or the adjustable weight device may have a movable member.

The adjustable weight device includes a central portion from which two (2) weight mounts protrude. A first end of each weight mount is secured or other attached to the central portion. A second end of each weight mount is securable to the item to be hung.

On each weight mount is a sliding weight, which will slide along its mount. Each slidably mounted weight provides an adjusting mechanism to position the picture or other hangable item in a proper fashion whether or not the hanging is properly positioned.

One embodiment of the adjustable weight device includes a rotating member centrally located and rotably mounted in a fixed housing. The rotating member fits into a fixed wall mount in a slidable fashion. Then the rotating member can be caused to rotate pursuant to the position of the weights and achieve the desired position of the picture. In this fashion, it becomes unnecessary to perfectly mount the hanging device on the picture frame, in order to achieve the aesthetically pleasing position of the picture on the wall.

It is also possible to have the wall mount include the rotatable portion and the picture mount be the fixed portion. The weights on the picture line can cause the interior portion of the wall mount to rotate and position the picture in the proper fashion. Either way this device serves as a picture frame equalizer or leveler.

Still a third embodiment can be accomplished with a shaped wire attached to the item to be hung. The shaped wire includes a central coil aperture at a midpoint thereof. The coil aperture is preferably formed by coiling the central portion of the shaped wire.

A first weight arm and a substantially diametrically opposed second weight arm extend from the coil. Each weight arm has a slidably mounted weight thereon. Further, each weight arm terminates a right angle bend which is attached to the item to be hung.

The coil is then mounted over a nail or similar item. Each weight on each arm slides to a position in order to hold the item being hung properly in the position desired.

Picture frames, or similar objects that hang on a wall, thus have an equalizer or leveler attached to maintain stability at all times. Such a stabilizer can be attached to or imbedded on frames or objects that hang to maintain a correct level at all times. A similar stabilizer can be attached to a wall, so that frames or objects that hang may maintain a correct level at all times.

The stabilizer can be affixed to the wall or other surface to hold the object. The stabilizer will move freely so as to always maintain correct position. The stabilizer can be sized to fit the object being hung.

Moving parts of the hanging device preferably have a ball bearing mount to cooperate with the wall mount or wall equalizer hook. This hanging device can be used on any object that needs to remain straight on walls or flat surface. The hook or other wall attachment is centered and attached to object that will be hung on flat surface or wall.

The hook has a moveable part so it will move freely and will always remain in a straight position. The moveable parts may use lubricant, such as tetrafluoroethylene, or a ball bearing assembly to minimize of friction. The hook can also be imbedded in the frame of a picture or other object that will hang on a wall.

A additional spacer or stabilizer for hanging an object on a wall will keep objects or frames straight or level at all times. This stabilizer is centered on the object or frame. The stabilizer may also have a moveable wheel that can be balanced by adjustable weights that are set. The moveable wheel will be made of a material that will provide the least friction.

The adjustable weights are attached on each side of a center portion and may be secured in a desired position, frictionally or otherwise. Once the weights are secured and the stabilizer is centered on object or frame, the need to adjust again to maintain a level frame or object is minimized or eliminated.

Figure 2:
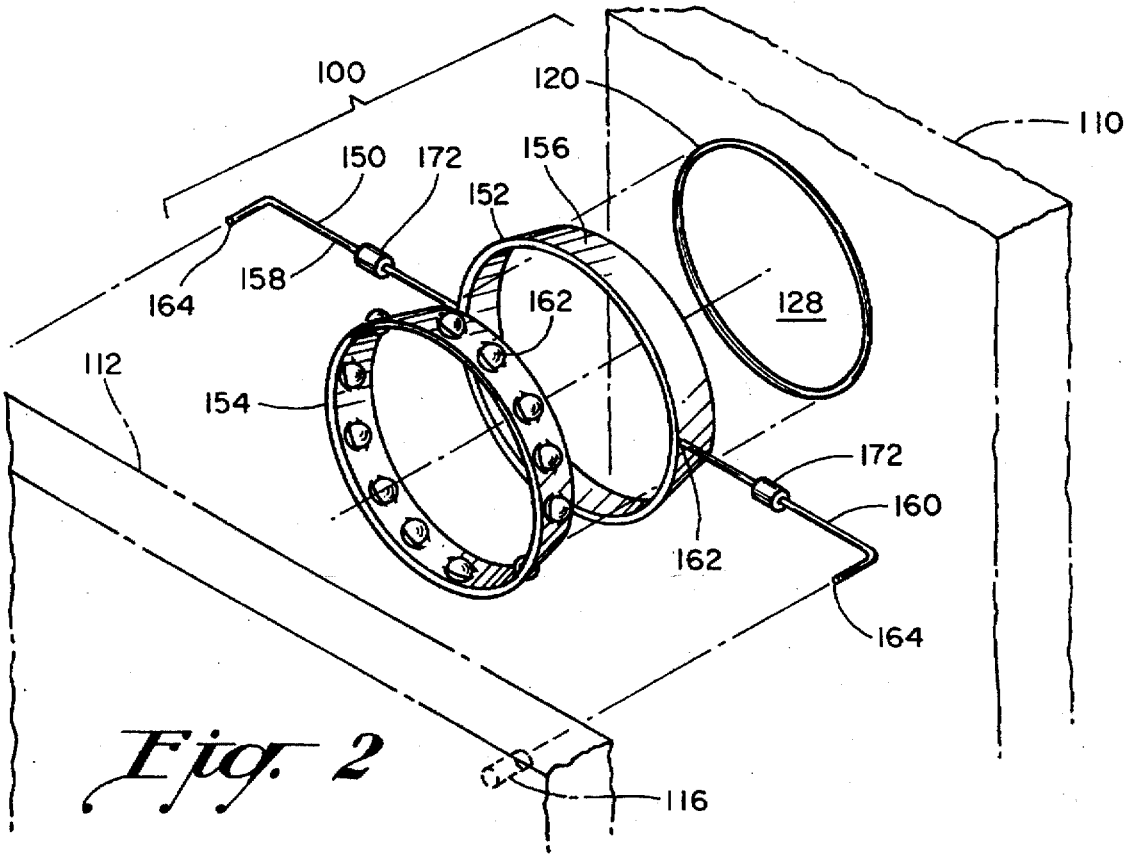
FIG. 2 depicts an exploded, perspective view of a first hanging device 100 for a picture 110, as shown in FIG. 1.

Referring now to FIG. 1 and FIG. 2, first hanging device 100 has a wall mount 120, which is mounted on a wall 110. Also, an adjustable weight device 150 is mounted on the picture 112. The adjustable weight device 150 joins with the wall mount 120 to form the first hanging device 100 and hang the picture 112 or other item on a wall.

The stationary wall mount 120 has a flat portion 122 to abut the wall 110. The flat portion 122 includes a securing aperture 124, which permits a nail 126 or similar device to secure the stationery wall mount 120 to the wall 112.

Centrally located in the stationery wall mount 120 is a male protrusion 128. This male protrusion 128 receives the adjustable weight device 150 with picture 112 or other item secured thereto. Thus mounted, the picture 112 may have an easily adjusted position.

The adjustable weight device 150 for first hanging device 100 includes a central housing portion 152. Central housing portion 152 includes a bearing mounted, rotatable member 154 within a support ring 156. Rotatable member 154 moves rather freely within and about the plane of the support ring 156.

From the support ring 156, a first weight mount 158 protrudes. Also from the support ring 156, a second weight mount 160 protrudes. A first end 162 of each weight mount 158 and 160 is secured to the support ring 156. A second end 164 of each weight mount 158 and 160 is securable to the item to be hung such as picture 112, in any standard fashion.

One manner of mounting to a picture is using second end 164. Second end 164 may be pointed or otherwise sharpened to penetrate a soft back mat of the picture 112. It also possible for picture 112 to include frame apertures 116 to receive second end 164 in a frictional relationship.

On each weight mount 158 and 160 is a slidably mounted weight 172, which will slide along its respective mount. Each slidably mounted weight 172 provides the adjusting to position of the picture 112 or other hangable item in a proper fashion, whether or not the hanging device 100 is properly positioned. Each slidably mounted weight 172 moves to an appropriate position by holding the picture 112 in the desired position.

Figure 3:
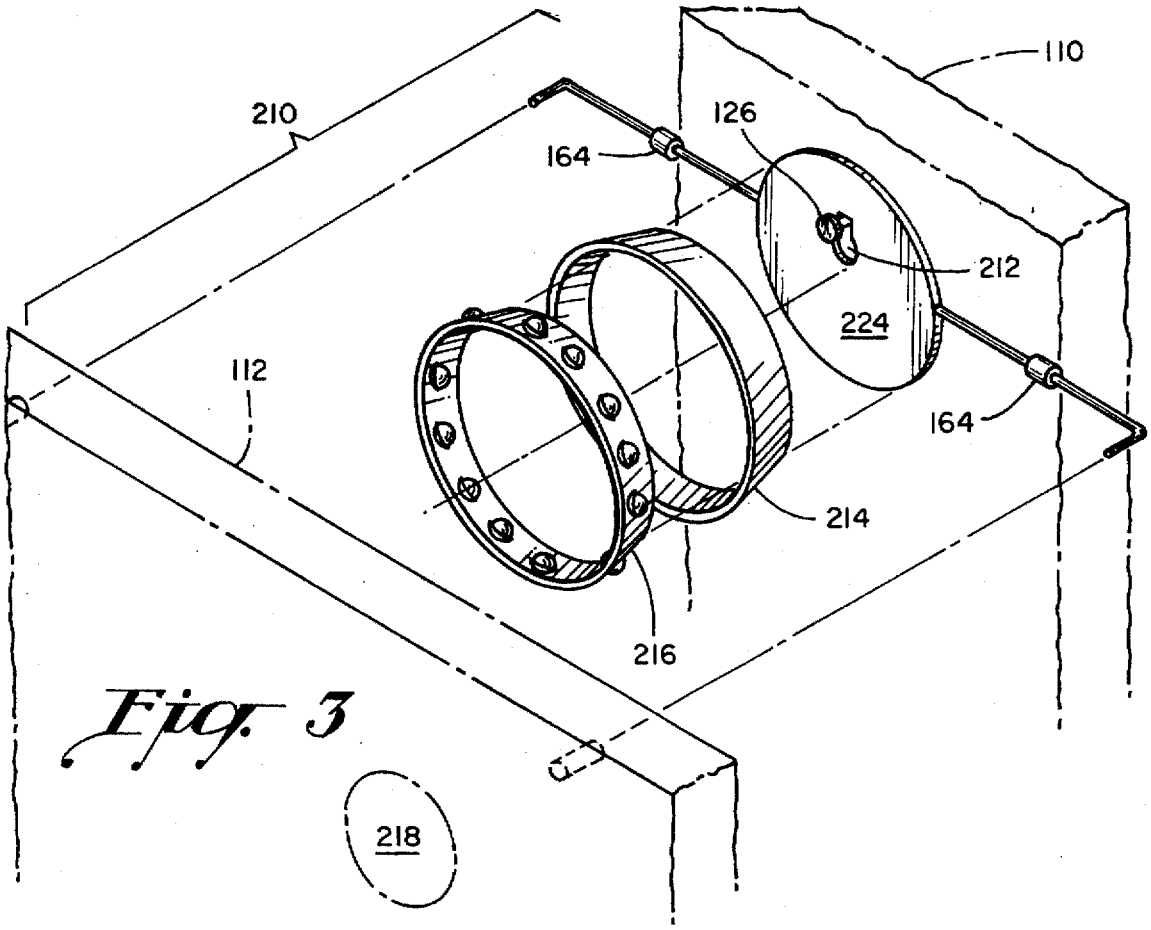
FIG. 3 depicts an exploded, perspective view of a second hanging device 200 for a picture 110.

With FIG. 3, the second picture hanging device 200 is depicted. This picture hanging device 200 is similar to the first hanging device 100. However, the back plate 210 which abuts the wall includes an slotted aperture 212 therein. This aperture 212 may fit over a nail 126 or other hanging device mounted in the wall 110. The rotational aspects of second picture hanging device 200 and rotational aspects of the picture 110 still permit the assemblage of the picture 112 on the wall 110. The structure of this device but for the back plate 210 is similar to the structure of FIG. 1.

In FIG. 3 an exploded, perspective view of a second hanging device 200 for a picture 110 is depicted. The second wall mount 210 includes a second rotating member 216 centrally located and rotably mounted in a second fixed housing 214. The second rotating member 216 snap fits into the second hanging device 200 mount in a slidable fashion. Then the second rotating member 216 can be caused to rotate pursuant to the position of the weights and achieve the desired position of the picture.

More specifically, the rotating wall mount 210 has a fixed portion 222 to abut the wall 110. The fixed portion 222 includes a fixed ring 224 with slotted aperture 212 therein, which permits a nail 126 or similar device to secure the rotating wall mount 210 to the wall 112.

Figure 4:
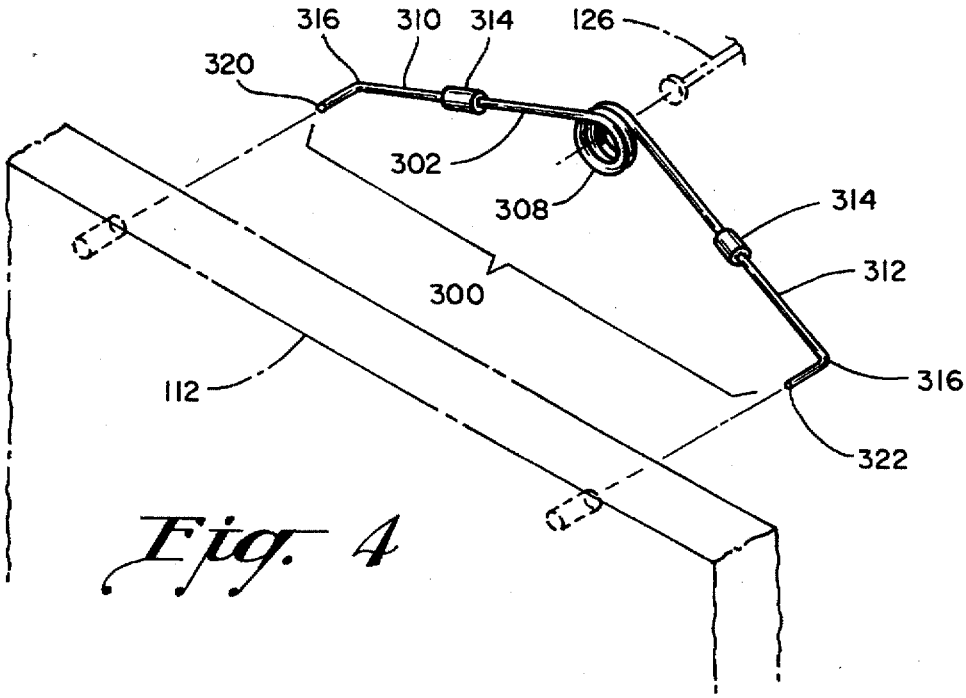
FIG. 4 depicts an exploded, perspective view of a third hanging device 300 for a picture 110.
Figure 5:
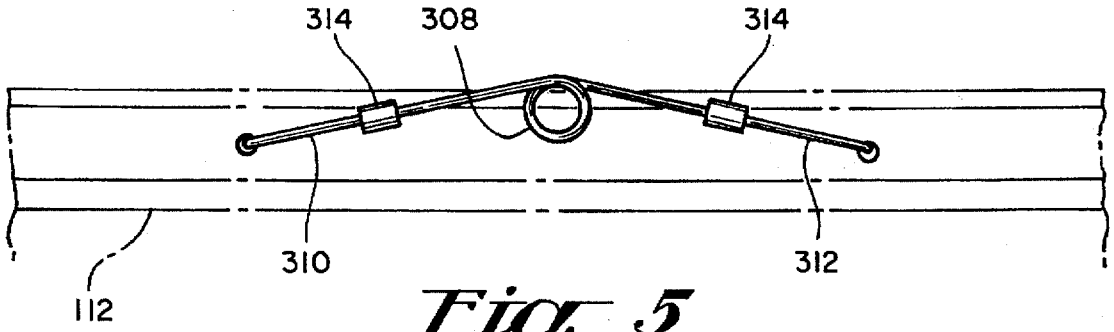
FIG. 5 depicts a rear view of the hanging device of FIG. 4.

In FIG. 4 and FIG. 5, is depicted a third hanging device this device consists of a wire 302, with a first weight arm 304 and a second weight arm 306 extending therefrom. Centrally located in the wire 302 is the coil 308. Slidably mounted on first wire 310 and second wire 312 are weights 314. At the end of each arm is a substantially right angle bend 316 forming a first arm 320 and a second arm 322 perpendicular to the axis of the coil 308. These arms can fit into the picture 110 and hold the picture 110.

The coil can then be mounted on a nail 112 in the wall 110 and achieve the rotation characteristics. As the weights 314 slide along the arms, the picture 110 is adjusted to its proper position.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A picture hanging device for hanging a picture in a proper position, comprising:

a) a picture means being attached to the picture;

b) the picture means including a shaped wire;

c) the shaped wire having a centrally located coil;

d) the centrally located coil having a first arm and a second arm extending therefrom;

e) the first arm having a first slidable weight mounted thereon;

f) the second arm having a second slidable weight mounted thereon;

g) the first arm being oppositely disposed from the second arm;

h) the first arm having a first attaching member oppositely disposed from the coil;

i) the second arm having a second attaching member oppositely disposed from the coil;

j) the first attaching member and the second attaching member being securable to the picture;

k) the first slidable weight being situated between the coil and the first attaching member; and l) the second slidable weight being situated between the coil and the second attaching member.

2. The picture hanging device of claim 1, further comprising:

a) the first attaching member being formed by a right angle bend in the first arm substantially parallel to an axis of the coil; and b) the second attaching member being formed by a right angle bend in the second arm substantially parallel to the axis of the coil; and c) the first attaching member being substantially parallel to the second attaching member.

* * * * *